United States Patent [19]

Sekiguchi

[11] Patent Number: 4,926,527

[45] Date of Patent: May 22, 1990

[54] ORNAMENTAL BUTTON

[75] Inventor: Jinichi Sekiguchi, Tokyo, Japan

[73] Assignee: Meikho Industry Corp., Ltd., Tokyo, Japan

[21] Appl. No.: 388,466

[22] Filed: Aug. 2, 1989

[30] Foreign Application Priority Data

Apr. 11, 1989 [JP] Japan ..... 1-89610

[51] Int. Cl.[5] ..... A44B 1/18

[52] U.S. Cl. ..... 24/90 A; 24/104

[58] Field of Search ..... 24/90 A, 90 R, 90 B, 24/90 C, 94, 95, 49 A, 163 K, 104, 106

[56] References Cited

U.S. PATENT DOCUMENTS

| | | | |
|---|---|---|---|
| 373,128 | 11/1887 | Cables | 24/90 A |
| 2,214,030 | 9/1940 | Pereles | 24/90 A |
| 3,439,439 | 4/1969 | Stimson | 24/90 A |
| 4,471,510 | 9/1984 | DeRosa | 24/90 A |
| 4,672,719 | 6/1987 | Scott . | |
| 4,683,621 | 8/1987 | Watanabe . | |
| 4,706,344 | 11/1987 | Tanaka et al. . | |

FOREIGN PATENT DOCUMENTS

| | | | |
|---|---|---|---|
| 1375507 | 9/1964 | France | 24/90 A |

*Primary Examiner*—Victor N. Sakran

*Attorney, Agent, or Firm*—Armstrong, Nikaido, Marmelstein, Kubovcik & Murray

[57] ABSTRACT

An ornamental button to be down on a clothing, furniture or the like which comprises a main body including a back seat plate having an arcuate slot adjacent to the periphery and a holding hole extending radially outwardly from the center of the plate and terminating at an enlarged diameter leading end, an operation seat plate rotatably disposed on the bottom of the back seat plate and including an operation projection adjacent to the periphery of the operation seat plate for fitting in the arcuate slot in the back seat plate and an operation hole extending radially outwardly from the center of the operation seat plate and terminating at an enlarged diameter leading end to align with and displace from the holding hole in the back seat plate while the operation seat plate is rotating and a spring for urging the operation seat plate against the bottom of the back seat plate; and a thread attachment ring detachably attached to the main body for guiding a thread therethrough.

3 Claims, 4 Drawing Sheets

ORNAMENTAL BUTTON

BACKGROUND OF THE INVENTION

This invention relates to an ornamental button to be used on a clothing, furniture or the like.

A veriety of ornamental buttons have been known including those formed of shell or hard synthetic resin. One of the prior art ornamental buttons is shown in FIGS. 17 and 18. In the prior art ornamental button shown in these figures, the button is provided with a plurality of vertical through holes 2 through which a thread is passed. In the prior art ornamental button shown in FIG. 19, a depending projection 4 is formed on the undersurface of the button and the projection is provided with a thread hole 5 through which a thread is passed. In the prior art ornamental button shown in FIGS. 20 to 22 inclusive, the button is formed of walnut material and comprises a cap-shaped surface seat plate 7 having a peripheral flange 6, a back seat plate 9 having a low upright peripheral flange 8 adapted to fit within the peripheral flange 6 of the surface seat plate 7, and holes 11, 11 a walnut element 10 covering the surface seat plate 7 and a thread attachment ring 12 firmly fit in the holes 11, 11 against inadvertent detachment from the back seat plate 9.

The prior art ornamental buttons are adapted to be sewn on a clothing, furniture of the like by the utilization of the threads hole 2, the hole 5 in the projection 5 or the thread attachment ring 12.

Of late, the ornamental buttons have become gorgeous and many of the buttons have been formed of precious metals resulting in high cost buttons. Thus, the buttons tend to come off the clothing or the like and are lost or get damaged resulting in great loss. In the cleaning of the clothing on which the ornamental button is sewn, up to date, the thread which sews the button on the clothing has to be cut off to remove the button from the clothing and after the cleaning, the button has to be again sewn on the clothing. The thread cutting and resewing have to be repeated each time cleaning is performed.

SUMMARY OF THE INVENTION

Thus, the present invention is to provide an ornamental button which can be simply removed from the clothing, furniture or the like without cutting off the thread which sews the button on the clothing.

According to the present invention, in order to sew the button on the clothing or the like by the thread attachment ring having an annular thread guide eye is detachably attached to the button main body.

According to the present invention, there is provided an ornamental button adapted to be sewn on a clothing, furniture or the like by a thread which has passed through a thread attachment ring provided on the bottom of said button and having a thread guide eye, comprising a main body and said thread attachment ring, said main body including a back seat plate having a circular flat bottom with an arcuate guide slot adjacent to the peripheral edge and a holding hole extending radially outwardly from the center of said bottom and terminating at an enlarged diameter leading end, an operation seat plate rotatably disposed on said bottom of the back seat plate and provided with an operation projection adjacent to the periphery of said operation seat plate to fit in said guide slot and an operation hole extending radially outwardly from the center of the operation seat plate and terminating at an enlarged diameter leading end to be aligned with or displaced from said holding hole in the back seat plate during the rotation of said operation seat plate and a spring disposed on said bottom of the back seat plate for urging said operation seat plate against the bottom of the back seat plate and said thread attachment ring including a stopper having such a diameter allowed to be inserted via said enlarged diameter ends of the holding and operation holes when the two holes align with each other but not to be allowed to be inserted into the holding and operation holes via the inner ends of said holding and operation holes having a diameter smaller than that of said enlarged diameter leading ends, a neck having such a thickness allowed to be inserted even in said smaller diameter inner ends of the holding and operation holes and attached said stopper thereto, an attachment portion secured thereto, an attachment portion secured to one end of said neck and a thread guide eye connected to the other end of said neck to guide a thread therethrough.

The above and other objects and attendant advantages of the present invention will be more readily apparent to those skilled in the art from a reading of the following detailed description in conjunction with the accompanying drawings which show preferred embodiments of the present invention for illustration purpose only, but not limiting the scope of the same in any way.

BRIEF DESCRIPTION OF THE DRAWINGS

FIGS. 1 to 15 show a first embodiment of the ornamental button according to the present invention wherein:

FIG. 1 is a front side plan view of said ornamental button;

FIG. 2 is a reverse side plan view of said ornamental button;

FIG. 3 is a sectional view taken along substantially the line III—III of FIG. 1;

FIG. 4 is a front side plan view of the ornamental surface member of said ornamental button;

FIG. 5 is a sectional view taken along substantially the line V—V of FIG. 4;

FIG. 6 is an elevational view of the spring of said ornamental button;

FIG. 7 is a front side plan view of the washer of said ornamental button;

FIG. 8 is a sectional view taken along substantially the line VIII—VIII of FIG. 7;

FIG. 9 is a front side plan view of the operation seat plate of said ornamental button;

FIG. 10 is a sectional view taken along substantially the line X—X of FIG. 9;

FIG. 11 is a reverse side plan view of the back seat plate of said ornamental button;

FIG. 12 is a sectional view taken along substantially the line XII—XII FIG. 11;

FIG. 13 is a front side plan view of the thread attachment ring;

FIG. 14 is a reverse side plan view of the thread attachment ring showing the thread guide eye of the ring held in position on the main body of the button;

FIG. 15 is a reverse side plan view of said ornamental button showing how to detachably attach the thread attachment ring to the main body of the button;

PREFERRED EMBODIMENTS OF THE INVENTION

Figure 1:
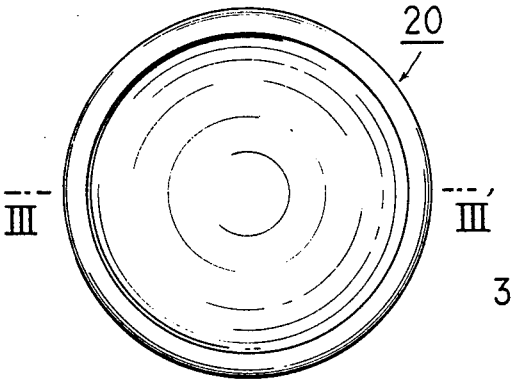
Figure 2:
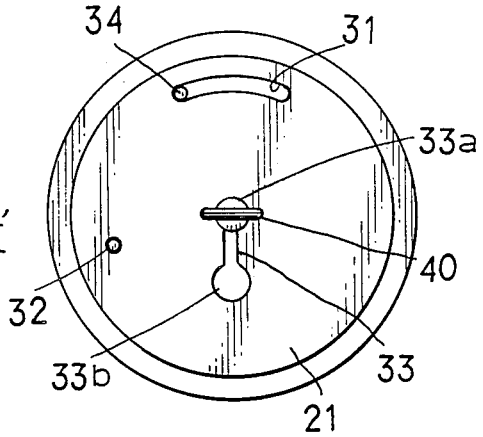
Figure 4:
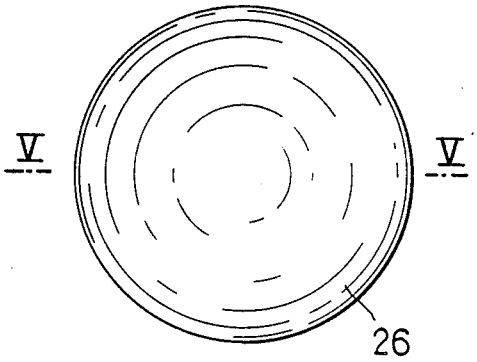
Figure 7:
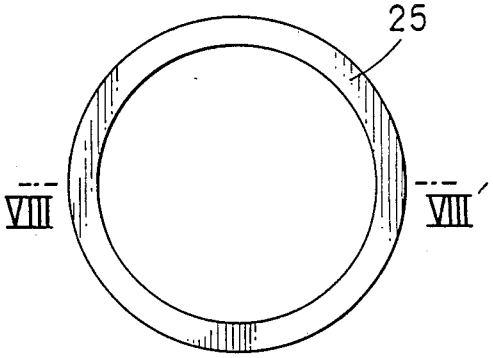

The present invention will be now described referring to the accompanying drawings.

Referring numeral 21 denotes the back seat plate of the ornamental button according to the present invention. The bottom 22 of the back seat plate 21 is formed with an arcuate guide slot 31 in a position adjacent to the outer periphery of seat plate 21 and a thread attachment ring holding hole 33 extending radially outwardly from the center of the bottom 22 and terminating at the enlarged diameter leading or outer end 33*b*. A disc shaped operation seat plate 23 is provided within the back seat plate 21 and provided with in its periphery with an upwardly extending projection 34 received in the arcuate guide slot 31. The operation seat plate 23 is further provided with an operation hole 36 extending radially outwardly from the center of the plate 23. The hole 36 corresponds to the holding hole 33 in the back seat plate 21 in shape and coextends with the hole 33. The operation seat plate 23 is rotatably disposed on the bottom 22 of the back seat plate 21 and a spring 24 is provided to bias the operation plate 23 against the bottom 22 to thereby provide the main body 20 of the ornamental button. A thread attachment ring 40 can be inserted into the button main body 20 by means of the ends 33*b*, 36*b* of the aligned holes 33, 36 in the back seat and operation seat plates 21, 23. The ring 40 comprises a stopper 43 for preventing the coming of the ring 40 off the inner ends 33*a*, 36*a* of the slots 33, 36 positioned in the center of the main body 20, a neck 45 having a thickness to be inserted in the ends 33*a*, 36*a* of the holes 33, 36, a thread attachment portion 42 fixedly secured to the neck 45 and a thread guide eye 41 through which a thread is passed.

It is preferable that the bottom 22 of the back seat plate 21 is provided with a hole 32 and the operation seat plate 23 is provided with an upright a projection 35 adapted to fit in the hole 32.

As described hereinabove, the operation seat plate 23 is disposed on the bottom 22 of the back seat plate 22 and the projection 34 of the operation seat plate 23 is received in the arcuate guide slot 31 in the back seat plate 21 and therefore, the operation projection 34 on the operation seat plate 23 can be reciprocally moved within the guide slot 31 in the back seat plate 21 on the back side of the ornamental button main body 20 and as the projection 34 moves reciprocally within the slot 31, the operation seat plate 23 rotates. Since the operation seat plate 23 is biased against the bottom of the back seat plate 21 by the spring 24, the rotation of the operation seat plate 23 is subjected to control by friction force producing between the bottom 22 of the back seat plate 21 and the operation seat plate 23 to thereby prevent inadvertent rotation of the operation seat plate 23.

As mentioned hereinabove, since the bottom 22 of the back seat plate 21 and the operation seat plate 23 are provided with the holding hole 23 and the operation hole 36, respectively, the inner end of each of the holes 33 and 36 is positioned in the center of the associated plate and the hole extends radially outwardly from the inner end positioned in the center of the associated plate, the ends 33*a*, 36*a* align with each other, but as the operation seat plate 23 rotates, the portions of the holes 33 and 36 extending radially outwardly from the inner ends 33*a*, 36*a* align with each other or displace from each other as the operation seat plate 23 rotates.

The attachment portion 42 of the thread attachment ring 40 includes a stopper 43 the diameter of which is smaller than that of the outer ends 33*b*, 36*b*. Thus, when the holes 33 and 36 align with each other, the thread attachment ring 40 can be inserted into the button main body 20 via the outer ends 33*b*, 36*b* of the holes 33, 36. Since the neck 45 is smaller in thickness than the diameter of the inner ends 33*a*, 36*a* of the holes 33, 36 positioned in the centers of the back plate bottom 22 and operation seat 23, when stopper 43 is inserted into the hole ends 33*a*, 36*a*, the neck 45 can be moved to the centers of the plates 21, 23. The thread attachment portion 42 of the thread attachment ring 40 is inserted in the aligned ends 33*b*, 36*b* of the holes 33, 36 and moved to the centers of the plates 21, 23 and the projection 34 rotates the operation seat plate 23. As the operation seat plate 23 rotates, when the holes 33 and 36 in the plates 21, 23 are out of alignment, the holes block each other except the ends positioned in the centers of the plates. As described hereinabove, the diameter of the stopper 43 is larger than that of the hole ends 33*a*, 36*a*, the thread attachment ring 40 would not inadvertently come out of the hole ends. That is, the ornamental button which has the thread attachment ring 40 affixed to the back side thereof can be sewn on a clothing or the like by use of a thread in the conventional manner.

With the ornamental button sewn on the clothing, the operation projection 34 is moved within the guide slot 31 in one direction so as to align the holes 33 and 36 with each other whereupon the thread attachment ring 40 can be moved to the hole ends 33*b*, 36*b* of the holes 33, 36 respectively. When the thread attachment ring 40 is positioned in the aligned hole ends 33*b*, 36*b*, the thread attachment ring 40 can be detached from the button main body 20 and vice versa because the diameter of the hole ends 33*b*, 36*b* is larger than that of the stopper 43.

That is, according to the present invention, the button main body 20 can be attached to or detached from the thread attachment ring 40 as the case may be.

Since the operation seat plate 23 is urged against the bottom 22 of the back seat plate 21 by the force of the spring 24, free rotation of the operation seat plate 23 is restrained and thus, there is no possibility that the operation seat plate 23 rotates inadvertently which would otherwise detach the button main body 20 from the thread attached ring 40.

In order to further ensure prevention of the inadvertent rotation of the operation seat plate 23, the back seat plate 21 is provided with the hole 32 and the operation seat plate 23 is provided with the projection 35, for fitting in the hole 32 respectively. The arrangement of the hole 32 and projection 35 is so made that when the holes 33, 36 are positioned in a predetermined maximum distance away from (FIG. 14) the aligning position (FIG. 15), the projection 34 fits in the hole 32 so that the operation seat plate 23 is prevented from inadvertent rotation.

Now, a first embodiment of the ornamental button according to the present invention will be described.

Figure 3:
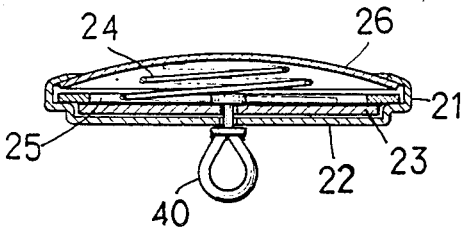
Figure 5:
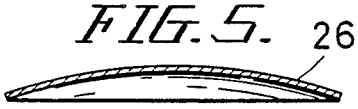
Figure 6:
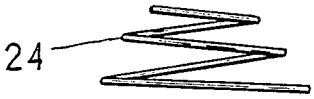
Figure 8:
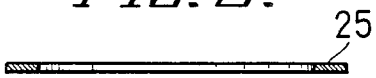
Figure 10:
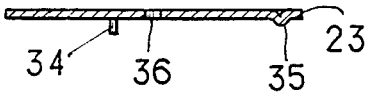

As more clearly shown in FIG. 3, the embodiment of the ornamental button main body 20 comprises the back seat plate 21 having the bottom 22, the operation seat plate rotatably disposed on the bottom 22, the spring 24 urging the operation seat plate 23 against the bottom 22 of the back seat plate 21, a washer 25 and an ornamental surface member 26. Now, the functions of these components and relationship between the components will be described.

Figure 12:
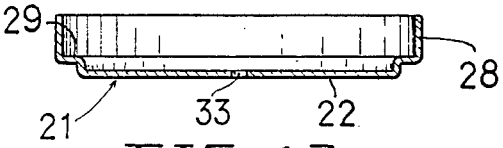
Figure 11:
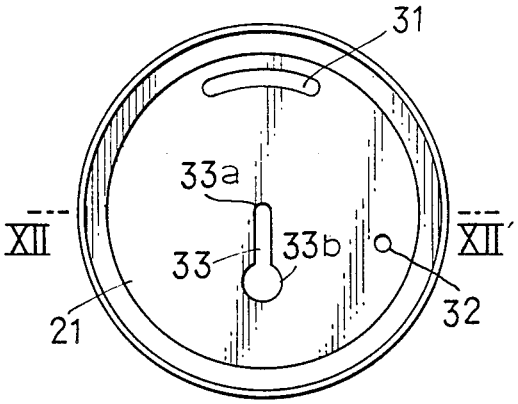

The back seat plate 21 is formed of a metal and as shown in FIG. 12, the back seat plate 21 includes an upwardly extending circular flange 28 about the periphery. The lower end portion of the peripheral flange 28 is bent inwardly to provide a shoulder 29 and the above-mentioned bottom 22 is formed in a position below the shoulder 29 by the distance corresponding to the thickness of the above-mentioned operation seat plate 23. As more clearly shown in FIG. 11, the bottom 22 of the back seat plate 21 is formed with the above-mentioned arcuate slot 31 adjacent to and inwardly from the periphery and the above-mentioned small hole 32 spaced radially outwardly from the guide slot 31. The hole 32 extends radially outwardly from the semi-circular inner end 33*a* positioned in the center of the back seat plate bottom 22 to the semi-circular leading end 33*b* which has the diameter greater than the width of the hole 33.

The operation seat plate 23 is disc having the thickness corresponding to the distance from the upper surface of the bottom 22 to the shoulder 29 of the bottom 22 and adapted to rotate on the bottom 22. The periphery of the operation seat plate 23 has the upwardly extending peripheral projection 34 to fit in the guide slot 31. The projection 35 adapted to fit in the hole 32 is formed by punching. The inner end 36*a* of the operation hole 36 extending radially outwardly from the center of the operation seat plate 23 has a semi-circle shape of the same diameter as that of the semi-circular end 33*a* of the holding hole 33 in the back seat plate 21. The holes 33, 36 are in the form off slots having the same length and thus, the slots can align with each other.

In the illustrated embodiment, although the holding hole 33 and the operation hole 36 are different with respect to shape, the two holes may have the same shape. In such a case, the two holes may take the shape of the hole 33 or 36, but in any case, it is necessary that the diameters of the inner ends 33*a*, 36*a* are smaller than those of the outer ends 33*b*, 36*b*, respectively and the inner and outer hole ends are connected to each other through the intermediate portions of the associated slots.

In the illustrated embodiment, although the projections 35 has been formed by punching the operation seat plate at the periphery thereof, but the projection may be formed by securing a separate member to the operation seat plate 23.

The washer 25 has been formed by punching an anular piece having a width just sufficient to stradle between the shoulder 29 and the operation seat plate 23 to hold the operation seat plate at the periphery. However, the washer 25 is not an absolutely necessary member. The spring 24 is provided for urging the operation seat plate 23 aginst the bottom 22 of the back seat plate 21 as mentioned hereinabove and in the illustrated embodiment, it is a coiled spring. The spring may be any other type spring.

Figure 16:
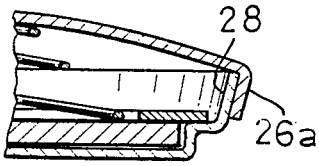
FIG. 16 is a fragmentary sectional view on an enlarged scale showing the caulking condition of the ornamental surface member and back seat plate in a second embodiment of the ornamental button according to the present invention.
Figure 17:
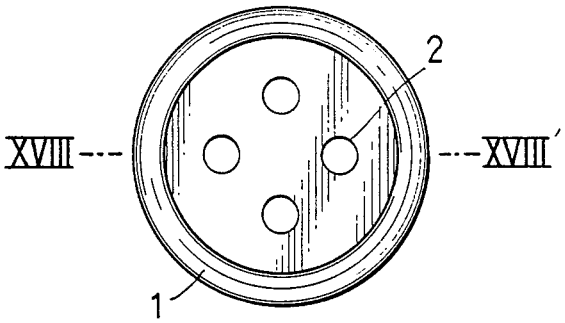
FIG. 17 is a front side plan view of a prior art ornamental button formed of shell or synthetic resin.
Figure 21:
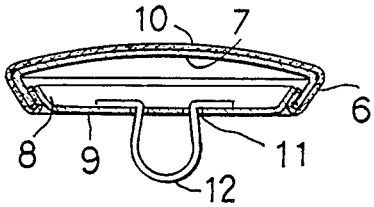
FIG. 21 is a sectional view taken along substantially the line XXI—XXI of FIG. 20.
Figure 22:
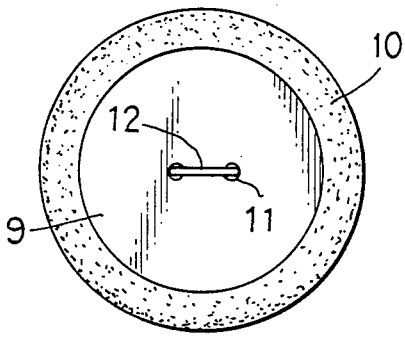
FIG. 22 is a reverse side plan view of the button shown in FIG. 20.
Figure 18:
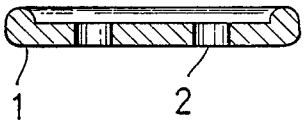
FIG. 18 is a sectional view taken along substantially the line XVIII—XVIII of FIG. 17.
Figure 19:
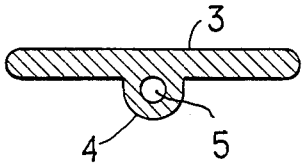
FIG. 19 is a reverse side plan view of another prior art button formed of shell or synthetic resin.
Figure 20:
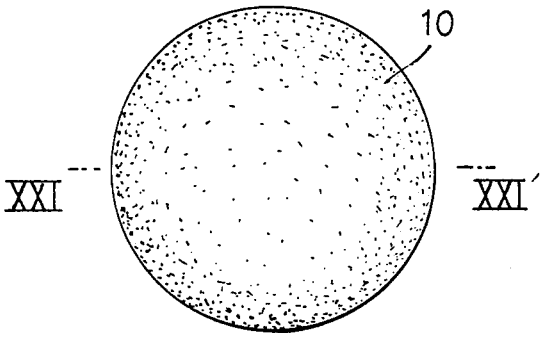
FIG. 20 is a front side plan view of a prior art ornamental button formed of walnut.

The ornamental surface member 26 has been formed by warping a disc material downwardly so as to make the diameter of the periphery of the disc substantially equal to that of the inner side of the peripheral upright flange 28. The ornamental surface member 26 constitutes an important member of the ornamental portion of the button and the ornamental surface member may be of any desired type provided that the size and shape of the periphery of the surface member corresponds to those of the inner side of the upright flange 28. The ornamental surface member 26 may bear any desired design. In the illustrated embodiment, although the ornamental surface member functions to hold the spring 24 down, the spring may be held down by another type member. The ornamental surface member 26 may be employed for ornamental purpose only. Furthermore, as more clearly shown in FIG. 16, like the prior art walnut button, it is also contemplated that the peripheral edge is bent downwardly to provide a depending peripheral flange to receive the upright flange 28 of the back seat plate 24 therein and the leading end of the upright flange 28 is caulked against the inner surface of the depending flange 26*a* of the ornamental surface member 26.

In assembly, first of all, the operation seat plate 23 is placed onto the bottom 22 of the back seat plate 21 and the washer 25 is placed onto the operation seat plate. Thereafter, the spring 24 is disposed onto the washer 25, the ornamental surface member 26 is placed onto the spring 24 and the leading end of the upright flange 28 of the back seat plate 23 is caulked against the inner surface of the depending flange 26*a* of the ornamental surface member 26 to thereby complete the ornamental button main body 20. At this time, the operation projection 34 of the operation seat plate 23 is fitted in the guide slot 31 in the back seat plate 21. As more clearly shown in FIG. 14, the positional relationship between the operation projection 34 and projection 35 is so made that when the operation projection 34 is positioned at one end of the guide slot 31 and the projection 35 is fitted in the hole 32.

Thus, the operation seat plate 23 is allowed to rotate within the range wherein the operation projection 34 moves in the guide slot 31. The rotation of the operation seat plate 23 is under control with frictional force producing between the back seat plate bottom 22 and the operation seat plate 23 because the operation seat plate 23 is biased against the botom 22 by the spring 24. The frictional force is produced by the force of the spring 24 and the force is so selected that the operation seat plate is prevented from inadvertent rotation, but allowed to rotate by imparting a certain amount of manual force to the operation seat plate 23. And when the projection 35 is fitted in the hole 32 and the projection 35 fitted in the hole 32 is subjected to the force of the spring 24. Thus, unless a force greater than the force of the spring 24 is applied to the operation projection 34, the operation seat plate 23 would not rotate. Once rotated, the operation seat plate 23 continues to rotate under control by the above-mentioned frictional force.

In the above-mentioned button main body 20, since the bottom 22 of the back seat plate 24 and the operation seat plate 23 are provided with the holding hole 33 and operation hole 36, respectively, and the inner ends 33*a*, 36*a* of these holes 33, 36 always aligh with each other, the hole ends maintain their aligned relationship whatever position the operation seat plate may take during it is rotating. On the other hand, since the outer ends **33*b*, 36*b* of the holes 33, 36 extending radially outwardly from the inner ends align with each other or displace from each other during the rotation of the operation seat plate 23. The outer ends 33b, 36b align with each other when the operation projection 34 is positioned at the end of the guide slot 31 opposite from the end of the slot where the projection 35 on the operation plate 23 fits in the hole 32 in the back seat plate 21**.

Figure 13:
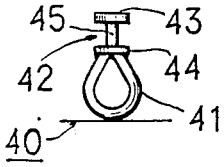
Figure 9:
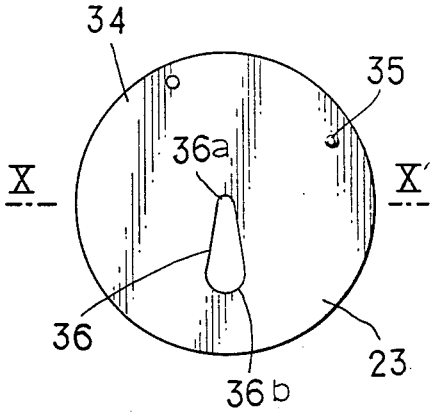

The thread attachment ring 40 shown in FIG. 13 is detachably attached to the button main body 20 described hereinabove. The thread attachment ring 40 includes the thread guide eye 41 through which a thread is passed and which is formed with the attachment portion 42. In the illustrated embodiment, the attachment portion 42 includes the pair of disc shaped opposing stoppers 43, 44 and the neck 45 connecting between the stoppers 43, 44.

The diameter of the stopper 43 is greater than that of the inner ends **33*a*, 36*a* of the holes 33, 36 and slightly smaller than that of the outer ends 33*b*, 36*b* of the holes 33, 36. And the neck 45 is in the form of a bar having the diameter smaller than that of the inner ends 33*a*, 36*a* of the holes 33, 36. The diameter of the stopper 44 may be equal to or larger than that of the stopper 43. The length of the neck 45 is longer than the thickness of the combined thickness of the operation seat plate 23 and the bottom 22 of the back seat plate 21 so as to pinch the back seat and operation seat plates by the stoppers 43, 44**.

Figure 14:
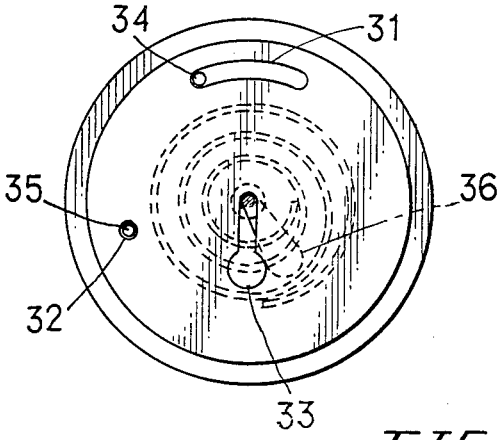
Figure 15:
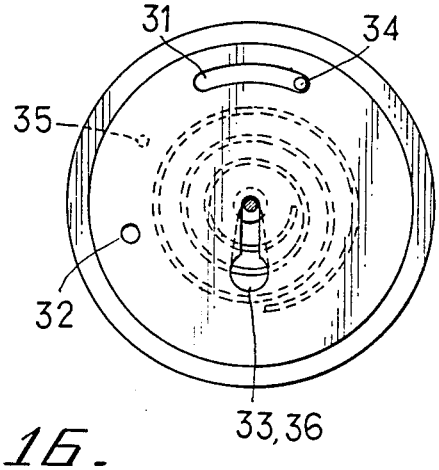

In order to detachably secure the thread attachment ring 40 to the ornamental button main body 20, first of all, the operation seat plate 23 is rotate by moving the operation projection 34 in the guide slot 31 in one direction so as to align the holding hole 33 and operation hole 36 and more particularly align the outer ends **33*b*, 36*b* of the holes 33, 36 with each other as shown in FIG. 15. Next, the stopper 43 on the thread attachment ring 43 is inserted through the aligned outer ends 33*b*, 36*b* of the holes 33, 36 into the holes and then moved to the inner ends 33*a*, 36*a* of the holes. Therefore, the operation projection 34 is then moved in the opposite direction within the guide slot 31. As the operation projection 34 moves in the opposite direction, the operation seat plate 23 rotates in the opposite direction so as to displace the operation hole 36 with respect to the holding hole 33 as shown in FIG. 14. In this position, the neck 45 of the thread attachment ring 40 is within the aligned inner ends 33*a*, 36*a*. The thread attachment ring 40 is prevented from inadvertently getting out of the holds 33, 36 because the diameter of the stopper 43 is greater than the diameter of the inner ends 33*a*, 36*a* of the holes 33, 36. When the thread attachment ring 40 is attached to the main body 20 in this manner, the projection 35 fits in the hole 32 to temporally hold the operation seat plate 23 against rotation. The fitting of the projection 35 in the hole 32 and the biasing force provided by the spring 34 restricts free rotation of the operation seat plate 23 and there is no possibility of inadvertent rotation of the operation seat plate 23 in use of the ornamental button. On the other hand, when the operation projection 34 is moved to the position within the guide slit 31 as shown in FIG. 15, the thread attachment ring 40 can be removed for the main body 20**.

The cleaning of the clothing on which the ornamental button of the invention is sewn, the button main body 20 can be removed for the clothing leaving the thread attachment ring 40 sewn on the clothing. After the cleaning operation, the main body can be simply replaced to the ring 40.

As described hereinabove, the main body 20 can be simply attached to the clothing and removed from the clothing leaving the thread attachment ring 40 sewn on the clothing. Thus, the combersome operations experienced in cleaning of the clothing on which the prior art buttons are sewn such as removing the button from the clothing by cutting off the thread which sews the button on the clothing and after the cleaning, the button is being again sewn on the clothing can be eliminated.

Furthermore, according to the ornamental button according to the present invention, since the operation seat plate by means of which the button main body is attached to the thread attachment ring is urged against the bottom of the back seat plate under the force of the spring, the operation seat plate is always braked by the spring and thus, the operation seat plate is prevented from rotating inadvertently and inadvertent detachment of the main body from the thread attachment is prevented and the possibility of inadvertent detachment of the main body can be further reduced by the fitting of the projection 35 in the hole 32.

While preferred embodiments of the invention have been shown and described in detail, it will be understood that the same are for illustration purpose only and not to be taken as a definition of the invention and reference should be given to the appended claims for the purpose.

What is claimed is:

1. In an ornamental button adapted to be sewn on a clothing, furniture or the like by a thread which has passed through a thread attachment ring provided on the bottom of said button and having a thread guide eye, characterized by:

(1) a main body including:

a back seat plate having a circular flat bottom provided with an arcuate guide slot adjacent to the peripheral edge and a holding hole extending radially outwardly from the center of said bottom and terminating at an enlarged diameter leading end;

an operation seat plate rotatably disposed on said bottom of the back seat plate and provided with an operation projection adjacent to the periphery of said operation seat plate to fit in said guide slot and an operation hole extending radially outwardly from the center of the operation seat plate and terminating at an enlarged diameter leading end to be align with or displaced from said holding hole in the back seat plate during the rotation of said operation seat plate; and a spring disposed on said bottom of the back seat plate for urging said operation seat plate against said bottom of the back seat plate and (2) a thread attachment ring detachably attached to the back of said main body and including:

a stopper having such a diameter allowed to be inserted via said enlarged diameter ends of the holding and operation holes into said holding and operation holes when the two holes align with each other but not to be allowed to be inserted into the holding and operation holes via the inner ends of said holding and operation holes having a diameter smaller than that of said enlarged diameter leading ends;

a neck having such a thickness allowed to be inserted even in said smaller diameter inner ends of the holding and operation holes and attached said stopper thereto, an attachment portion secured to one end of said neck; and a thread guide eye connected to the other end of said neck to guide a thread therethrough.

2. An ornamental button as set forth in claim 1 wherein said back seat plate is formed on the bottom with a hole in a position spaced radially outwardly from said holding hole and said operation seat plate is provided with a projection in a position space radially outwardly from said operation hole to fit in said hole in the bottom of the back seat plate.

3. An ornamental button as set forth in claim 1 wherein said operation seat plate is fitted in the shoulder of said back seat plate and held down by a washer disposed on the operation seat plate.

* * * * *